US005979788A

United States Patent [19]

Rancourt et al.

[11] Patent Number: 5,979,788

[45] **Date of Patent: *Nov. 9, 1999**

[54] PRESSURE WASHER VALVE ASSEMBLY

[75] Inventors: Timothy Curtis Rancourt, Faribault; Stephen Emerson Babcock, Burnsville, both of Minn.

[73] Assignee: Northern Tool & Equipment Company, Inc., Burnsville, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/753,326

[22] Filed: Nov. 21, 1996

[51] Int. Cl.[6] ..... B05B 17/04

[52] U.S. Cl. ..... 239/11; 239/75; 239/124; 417/32; 417/308; 137/115.13; 137/468

[58] Field of Search ..... 239/75, 124, 127, 239/532; 137/115.13, 118.06, 468, 11; 417/32, 307, 308

[56] References Cited

U.S. PATENT DOCUMENTS

| | | | |
|---|---|---|---|
| 3,457,941 | 7/1969 | Cook | 417/307 X |
| 3,608,824 | 9/1971 | Ballou | 239/124 |
| 3,628,727 | 12/1971 | Gjerde | 239/124 |
| 5,215,444 | 6/1993 | Bishoff | 417/307 X |
| 5,641,119 | 6/1997 | Simonette | 236/92 |

OTHER PUBLICATIONS

Brochure—General Pump Incorporated, Aug. 1992.

*Primary Examiner*—Andres Kashnikow
*Assistant Examiner*—Steven J. Ganey
*Attorney, Agent, or Firm*—Schwegman, Lundberg, Woessner, & Kluth PA

[57] ABSTRACT

The present disclosure relates to a valve assembly suitable for use on a pressure washer pump. The valve assembly includes an unloader valve having an inlet port sized and configured to be connected directly to the pressure washer pump. The unloader valve also includes an outlet port sized and configured to be placed in fluid communication with a release mechanism. The unloader valve further includes a bypass port sized and configured to be placed in fluid communication with the pressure washer pump. Finally, the valve assembly also includes a thermal relief valve connected directly to the unloader valve at a location generally opposite from the bypass port.

14 Claims, 3 Drawing Sheets

PRESSURE WASHER VALVE ASSEMBLY

FIELD OF THE INVENTION

The present invention relates to pressure washers and more particularly, to a valve assembly for pressure washers.

BACKGROUND OF THE INVENTION

A prior art pressure washer is designated as 50 in FIG. 3. The pressure washer 50 includes a positive displacement pressure washer pump 160 having at least four ports, two of which are designated as 162 and 164, and two of which are opposite the ports 162 and 164 but not visible in FIG. 3.

An unloader valve 100 is placed in fluid communication with the pump 160 via two of the four ports. The unloader valve 100 has an inlet port 112, an outlet port 114, and a by-pass port 116. The outlet port 114 is placed in fluid communication with a spray gun or other release mechanism (not shown).

The inlet port 112 is placed in fluid communication with the pump port opposite the port 162. In particular, a first elbow fitting 67 is connected to the inlet port 112, a second elbow fitting 67 is connected to the pump port, and a nipple 68 is interconnected between the two elbow fittings 67.

The by-pass port 116 is placed in fluid communication with the pump port 164. In particular, a hose barb 187 is interconnected between the by-pass port 116 and one end of a by-pass hose 76; another hose barb 187 is interconnected between an opposite end of the by-pass hose 76 and an inlet fitting 180; and an opposite end of the inlet fitting 180 is threaded into the pump port 164. Each end of the by-pass hose 76 is secured to a respective hose barb 187 by means of a hose clamp 178. An inlet filter 188 is disposed within the inlet fitting 180.

When the pump 160 is running and the spray gun is in use (the trigger is pulled), water flows into the inlet port 112 on the unloader valve 100 and out the outlet port 114. When the pump 160 is running and the spray gun is not in use (the trigger is released), water flows into the inlet port 112 on the unloader valve 100 and out the by-pass port 116. An adjustment knob 118 allows a user to adjust the amount of pressure in the water that is available to the spray gun.

A pop-off valve 120 is placed in fluid communication with the pump 160 via the port 162. In particular, one end of the pop-off valve 120 is threaded into the port 162. If water pressure exceeds a maximum threshold level, the pop-off valve 120 discharges water from the system. In this respect, the pop-off valve 120 is designed to be the weak link in the system from the standpoint of pressure.

A thermal relief valve 130 is placed in fluid communication with the pump 160 via the port opposite the port 164. In particular, one end of the thermal relief valve 130 is threaded into the port. If water temperature exceeds a maximum threshold level, which is more likely to happen when the pump runs too long in the by-pass mode, the thermal relief valve 130 discharges water from the system. In this respect, the thermal relief valve 130 is designed to be the weak link in the system from the standpoint of temperature.

The prior art pressure washer 50 is satisfactory in many respects but still leaves room for improvement. For example, numerous pieces of hardware are necessary to interconnect the various ports and valves. Also, this prior art system 50 uses all four of the ports on the pump 160.

SUMMARY OF THE INVENTION

The present invention provides a new and improved pressure washer. For example, the pop-off valve and the thermal relief valve are integrated into the unloader valve, so that all three safety measures are introduced into the system through a single port. The unused ports are left available for other uses, such as an idle down control, a pressure switch, etc.

The integrated nature of the valve reduces the number of hardware pieces required, as well as the amount of time required to assemble and/or service the preferred embodiment. Moreover, the new location of the thermal relief valve has proven to be surprisingly effective. These are some of the advantages of the present invention which will become apparent to those skilled in the art upon a more detailed description of the preferred embodiment.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
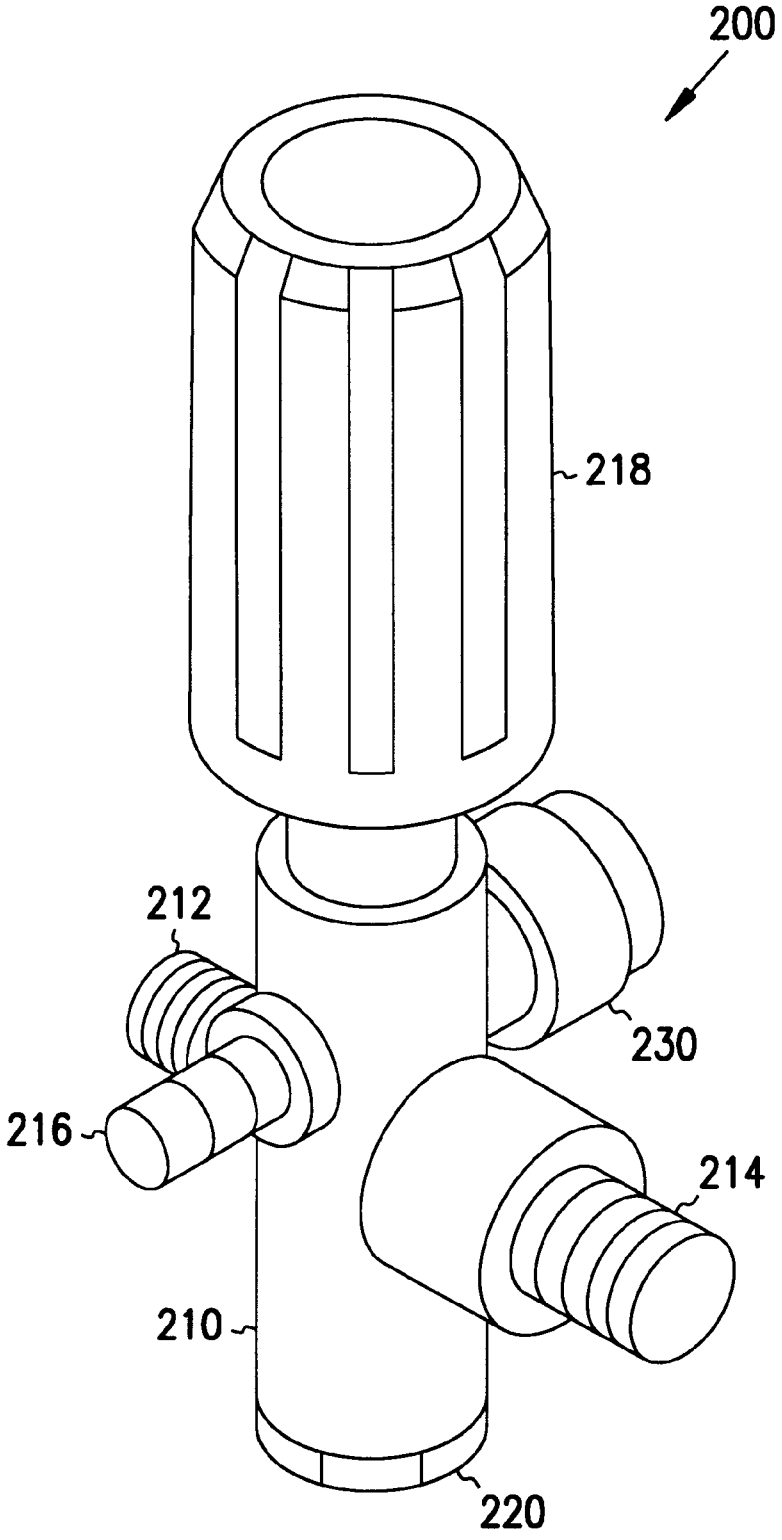
FIG. 1 is a perspective view of a preferred embodiment valve assembly constructed according to the principles of the present invention.
Figure 2:
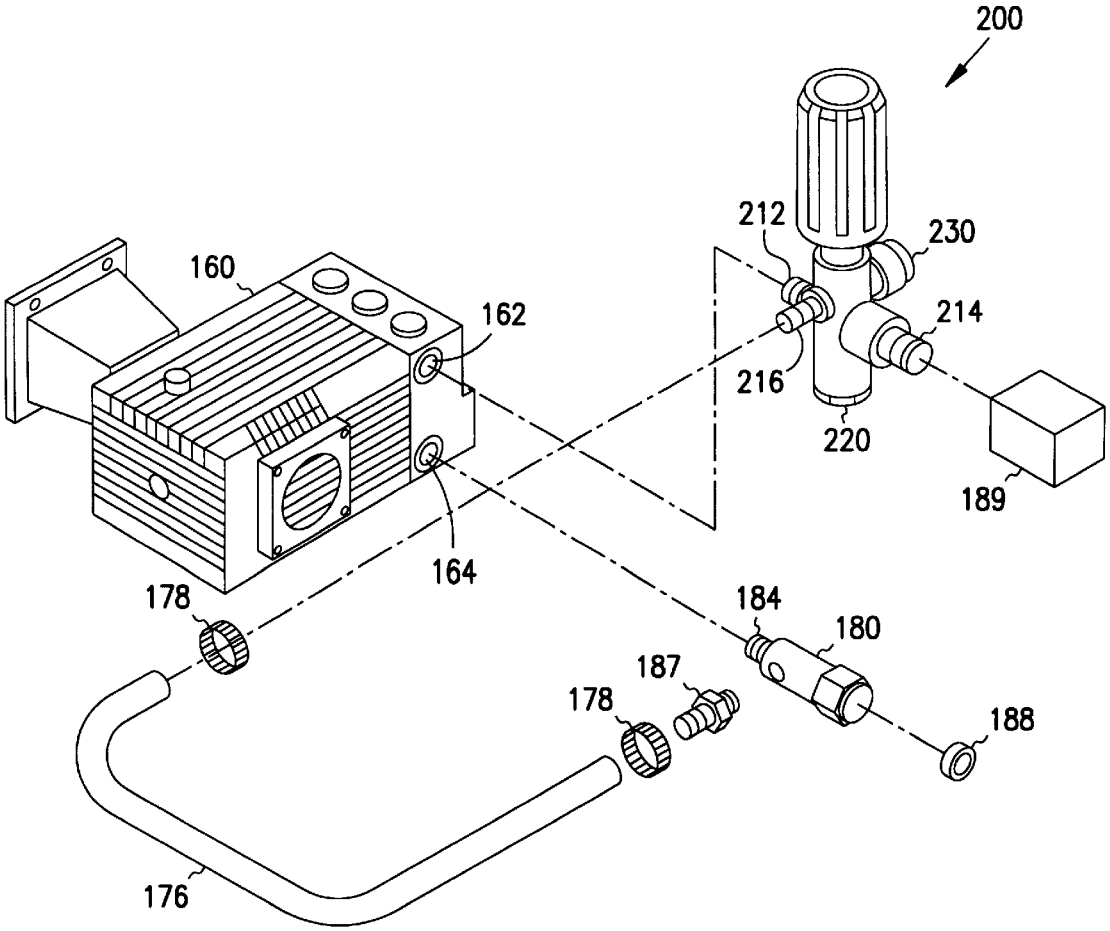
FIG. 2 is an exploded perspective view of a pressure washer including the valve assembly of FIG. 1.
Figure 3:
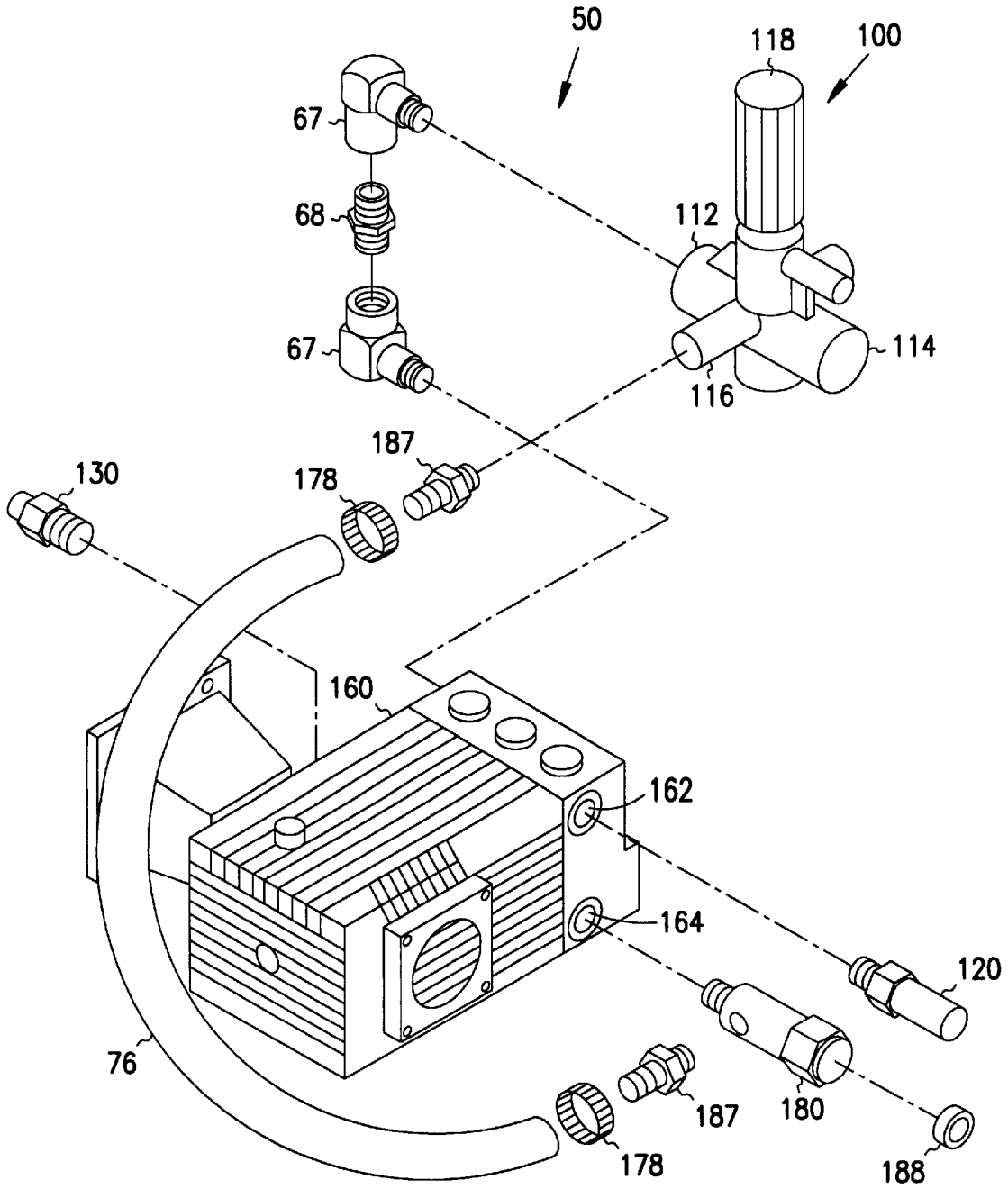
FIG. 3 (Prior Art)
FIG. 3 is an exploded perspective view of a prior art pressure washer and valve assembly.

A preferred embodiment valve assembly constructed according to the principles of the present invention is designated as 200 in FIGS. 1 and 2. The valve assembly 200 is suitable for use together with the positive displacement pressure washer pump 160 shown in FIGS. 2 and 3 and known in the art.

As shown in FIG. 1 the valve assembly 200 includes an unloader valve 210 having an inlet port 212, an outlet port 214, and a by-pass port 216. An optional pressure adjustment knob 218 is also shown on the assembly 200. A pop-off valve 220, such as that described among the prior art materials submitted herewith, is connected to the unloader valve 210, opposite the adjustment knob 218. A thermal relief valve 230, such as that described among the prior art materials submitted herewith, is connected to the unloader valve 210 opposite the by-pass port 216.

As shown in FIG. 2, the inlet port 212 is threaded into the pump port 162 to place the valve assembly 200 in fluid communication with the pump 160. The outlet port 214 is sized and configured to be placed in fluid communication with a spray gun or other release mechanism 189 known in the art. An end of a by-pass hose 176 is connected to the by-pass port 216 by means of a hose clamp 178. An opposite end of the by-pass hose 176 is connected to an inlet fitting 180 by means of a hose barb 187 and another hose clamp 178. A first end 184 of the fitting 180 is threaded into the pump port 164 (prior to connection of the by-pass hose 176 thereto). An inlet filter 188 is disposed within the fitting 180. The resulting pressure washer assembly 150 requires significantly fewer parts and assembly steps than the prior art pressure washer assembly shown in FIG. 3 and also, cleaves the two unshown pump ports available for other possible uses.

The valves 210, 220, and 230 function in a manner similar to their respective counterparts 100, 120, and 130 on the prior art device 50. In particular, the unloader valve 200 shunts water from the spray gun when the trigger is released;

the pop-off valve 220 is the weak link in the system from the standpoint of pressure; and the thermal relief valve 230 is the weak link in the system from the standpoint of temperature. However, the thermal relief valve 130 operates even better than expected for its location within the preferred embodiment system.

Although the present invention has been described with reference to a preferred embodiment and a specific application, those skilled in the art will recognize other embodiments and applications that fall within the scope of the present invention. Accordingly, the present invention is to be limited only to the extent of the appended claims.

What is claimed is:

1. A valve assembly suitable for use in regulating water temperature and pressure on a pressure washer pump, comprising:

an unloader valve having an inlet port sized and configured to be connected directly to the pressure washer pump, an outlet port sized and configured to be placed in fluid communication with a release mechanism for release of hot water under pressure, a by-pass port sized and configured to be placed in fluid communication with the pressure washer pump thereby recirculating water through the pump; and a thermal relief valve connected directly to the unloader valve generally opposite the by-pass port for release of water that is too hot.

2. The assembly of claim 1, further comprising a pop-off valve connected directly to the unloader valve for reducing pressure by venting water.

3. The assembly of claim 1, wherein the inlet port and the outlet port are generally opposite one another.

4. The assembly of claim 1, wherein the unloader valve has a longitudinal axis, and the inlet port and the outlet port form a first diametrically opposed pair, and the thermal relief valve and the by-pass port form a second diametrically opposed pair which is perpendicular to the first diametrically opposed pair.

5. The assembly of claim 4, further comprising a pop-off valve connected directly to an end of the unloader valve, axially displayed from the first diametrically opposed pair and the second diametrically opposed pair.

6. A method of making valve for a pressure washer pump, comprising the steps of: mounting a thermal relief valve on an unloader valve; and placing the unloader valve in fluid communication with the pressure washer pump.

7. The method of claim 6, wherein the placing step involves mounting the unloader valve on the pressure washer pump.

8. The method of claim 7, wherein the placing step further involves interconnecting a by-pass hose between the unloader valve and the pressure washer pump.

9. The method of claim 6, further comprising the step of mounting a pop-off valve on the unloader valve.

10. The method of claim 6, further comprising the step of mounting a pressure adjustment knob on the unloader valve.

11. A pressure washer utilizing water, comprising:

a pressure washer pump having at least a first port and a second port;

a spray mechanism for spraying water under pressure and at an elevated temperature;

an unloader valve having an inlet port connected to the first port, an outlet port connected to the spray mechanism, and a by-pass port connected to the second port; and a thermal relief valve connected to the unloader valve diametrically opposite the by-pass port for venting water.

12. The pressure washer of claim 11, further comprising a pop-off valve connected to an end of the unloader valve.

13. The pressure washer of claim 11, wherein the inlet port is connected directly to the first port, and a by-pass hose is interconnected between the by-pass port and the second port.

14. A method for regulating pressure and temperature in a pressure washer circuit, comprising:

providing a valve assembly that comprises an unloader valve connected to a pump, a by-pass port, a thermal relief valve connected directly to the unloader valve generally opposite the by-pass port, and a pop-off valve, wherein the valve assembly is connected to the pump at the unloader valve;

providing an inlet port;

regulating the pressure of the pressure washer circuit by activation of the pop-off valve which releases water from the circuit; and adjusting temperature with the thermal relief valve that vents water when water temperature in the circuit is too high so that cooler makeup water is introduced into the circuit through the inlet port.

* * * * *